United States Patent [19]

Szalanski et al.

[11] Patent Number: 4,575,014

[45] Date of Patent: Mar. 11, 1986

[54] VERTICAL SHAFT IMPACT CRUSHER RINGS

[75] Inventors: Scott E. Szalanski, Oak Creek; Kenneth Tess, Greendale, both of Wis.

[73] Assignee: Rexnord Inc., Brookfield, Wis.

[21] Appl. No.: 624,885

[22] Filed: Jun. 27, 1984

[51] Int. Cl.[4] ..... B02C 19/00

[52] U.S. Cl. ..... 241/275; 241/285 R

[58] Field of Search ..... 241/300, 275, 285 R, 241/285 A

[56] References Cited

U.S. PATENT DOCUMENTS

| | | | |
|---|---|---|---|
| 2,752,098 | 6/1956 | Adams | 241/197 |
| 3,148,840 | 9/1964 | Behnke | 241/275 |
| 3,174,698 | 3/1965 | Miller | 241/275 |
| 3,258,211 | 6/1966 | Behnke | 241/275 |
| 3,334,823 | 8/1967 | Behnke et al. | 241/275 |
| 3,474,974 | 10/1969 | Wood | 241/275 |
| 3,540,667 | 11/1970 | Parker | 241/275 |
| 3,606,182 | 9/1971 | Warren | 241/275 |
| 4,090,673 | 5/1978 | Ackers et al. | 241/275 |
| 4,166,585 | 9/1979 | Alford et al. | 241/275 |
| 4,389,022 | 6/1983 | Burk | 241/275 |

*Primary Examiner*—Mark Rosenbaum

*Attorney, Agent, or Firm*—Lawrence J. Crain

[57] ABSTRACT

A vertical shaft impact crusher is provided, having a cylindrical tank in which the rotor is mounted for rotation about a vertical axis and for receiving rock fed axially from above and having impeller shoes for accelerating and throwing the rock outward against an annular breaker ring; wherein the breaker ring is a circular hoop mounted to the interior of the tank and has a plurality of spaced mounting means designed to securely yet releasably hold a plurality of specially designed anvil members, each having a head comprised of a flat impact surface and an octagonal shaped periphery; a foot portion and a narrowed neck portion connecting said head and foot portions and engaging the mounting means so that the anvil may be indexed at a number of annular positions.

2 Claims, 9 Drawing Figures

VERTICAL SHAFT IMPACT CRUSHER RINGS

BACKGROUND OF THE INVENTION

This invention relates to rings for a vertical shaft impact crusher, and more particularly to an anvil breaker ring and a protective skirt ring for the rotor of a vertical shaft impact crusher.

A vertical shaft impact crusher having an anvil breaker ring normally includes a series of brackets around the breaker ring for supporting the breaker blocks or anvils at the correct orientation on the breaker ring. These have been found generally satisfactory in the past but due to the increased need for more efficient operation, the users of this equipment have, for a considerable period of time, sought greater efficiency and better utilization of the equipment.

Other than the initial capital cost of acquiring the equipment, the two greatest costs associated with the operation of a vertical shaft impact crusher are power consumption costs and replacement/repair of worn or consumed components. Power consumption costs can be minimized by increasing the efficiency of the power transmission train within the crusher and by increasing the rock breaking effectiveness of the breaking elements of the crusher. The repair/replacement costs can be minimized by maximizing the effectiveness of the components and minimizing the waste so that maximal utilization of the replacement/repair parts is achieved.

The components having the highest wear rate in a vertical shaft impact crusher are the breaker blocks or anvils on the breaker ring and the impeller shoes. Since the breaker block is impacted by high speed rocks thrown by the rotor, it is important that the breaker block be arranged in such a manner that the wear on the breaker block be uniform and that all of the breaker block material participate in the functional action of the rock crushing.

The rotating rotor of the vertical shaft impact crusher rotates in close proximity to the breaker ring and there will always be a certain amount of rock fragment rebound from the anvils. This fragment rebound impinges against the adjacent face of the rotor revolving at high speed and the outer radially facing surfaces of the rotor can become abraded by this action. The rotor must be protected from this action to prevent permanent or irreparable damage to the rotor which would be expensive to replace.

The floor and roof of the impeller chamber must be protected from abrasion by the rock as it is thrown outward from the rotor by some form of wear plate. Because the wear plate is subjected to high centrifugal force during operation of the spinning rotor, it must be securely held in place during operation to prevent catastrophic damage if it became loose. Such a wear plate is normally held in place by vertically extending attachment bolts, but it is also desirable to relieve the load on these attachment bolts and thereby provide greater security against their failure.

Thus, there has long been a need in the industry for a vertical shaft impact crusher which efficiently utilizes the anvil structure and protects the rotor from abrasive damage and catastrophic release of wear plates.

SUMMARY OF THE INVENTION

Accordingly, it is an object of the present invention to provide a vertical shaft impact crusher having an anvil and anvil support ring which obtains maximal effectiveness of the anvil breaker ring and the anvil blocks themselves. Another object of the present invention is to provide a rotor ring which protects the rotor from abrasion by rebounding rock fragments from the anvil breaker ring and supports the rotor wear plates against the centrifugal force exerted on them by the rotating rotor.

These and other objects of the invention are attained in a preferred embodiment of a vertical shaft impact crusher having an annular hoop on the inside surface of which are attached an array of brackets which support anvil breaker blocks having an octagonal face on an axis perpendicular to the flight trajectory of the rocks thrown by the rotor. The breaker block fits into a bracket which has a slotted cross arm and an underlying support plate which supports the anvil foot which is connected to the anvil head by a neck which fits into the cross arm slot. A protective ring or skirt is attached to the rotor below the impeller shoes to protect the rotor from erosive damage by rock fragments rebounding from the anvils. The protective ring is prestressed by welding in progressive fashion around the ring so that it thermally expands to close the gap, and then the edges of the split are welded closed so that when the ring cools from the heat imparted during welding it thermally contracts to apply a compressive hoop stress around the rotor to hold it securely in place. The ring projects above the top surface of the rotor base plate to locate and secure the wear plates on the rotor against centrifugal force encountered at high speed rotation of the rotor.

DESCRIPTION OF THE DRAWINGS

The invention, and its many attendant objects and advantages, will become more apparent upon reading the following description of the preferred embodiment in conjunction with the following drawings, wherein.

DESCRIPTION OF THE PREFERRED EMBODIMENT

Figure 1:
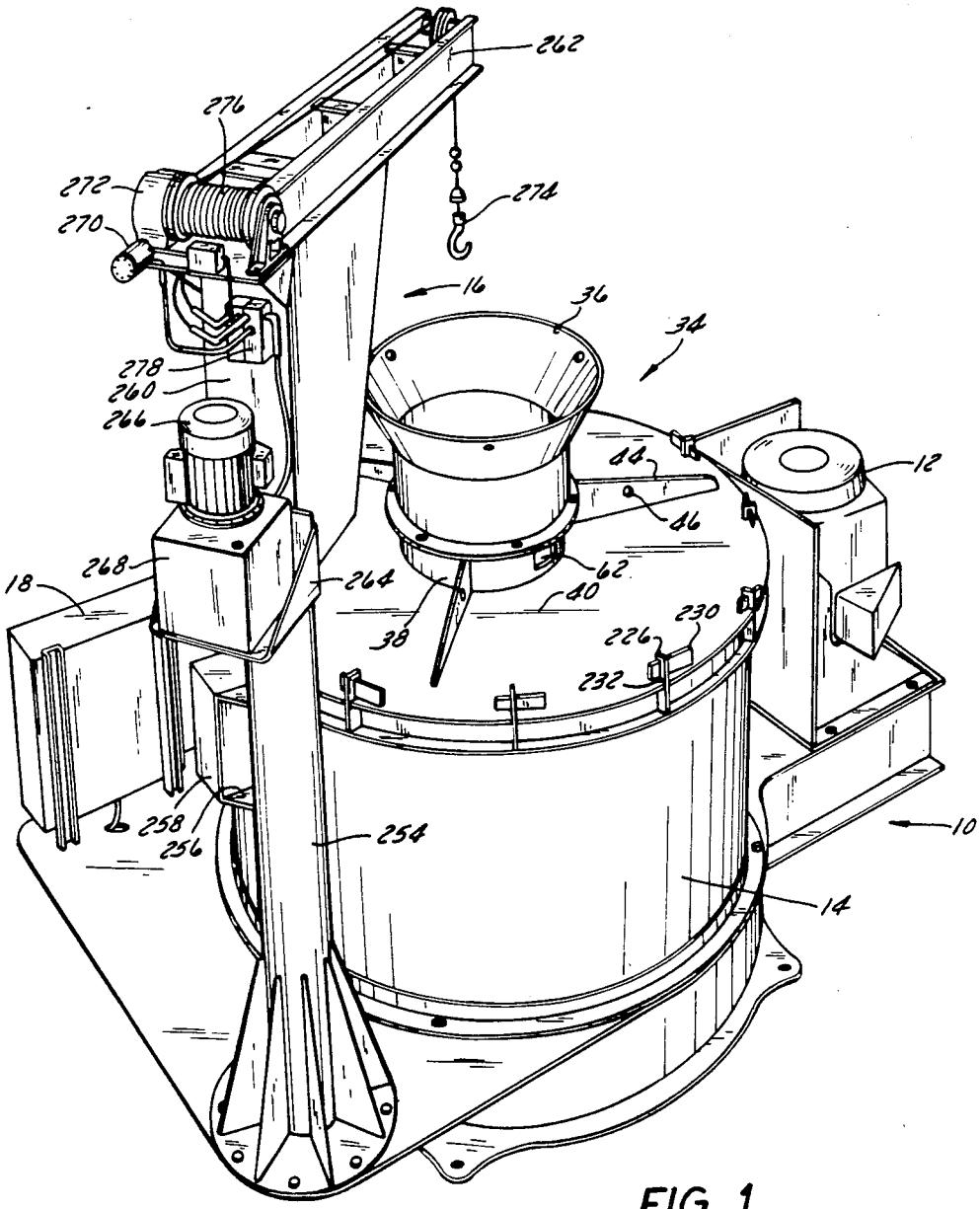
FIG. 1 is a perspective view of a vertical shaft impact crusher made in accordance with this invention.
Figure 2:
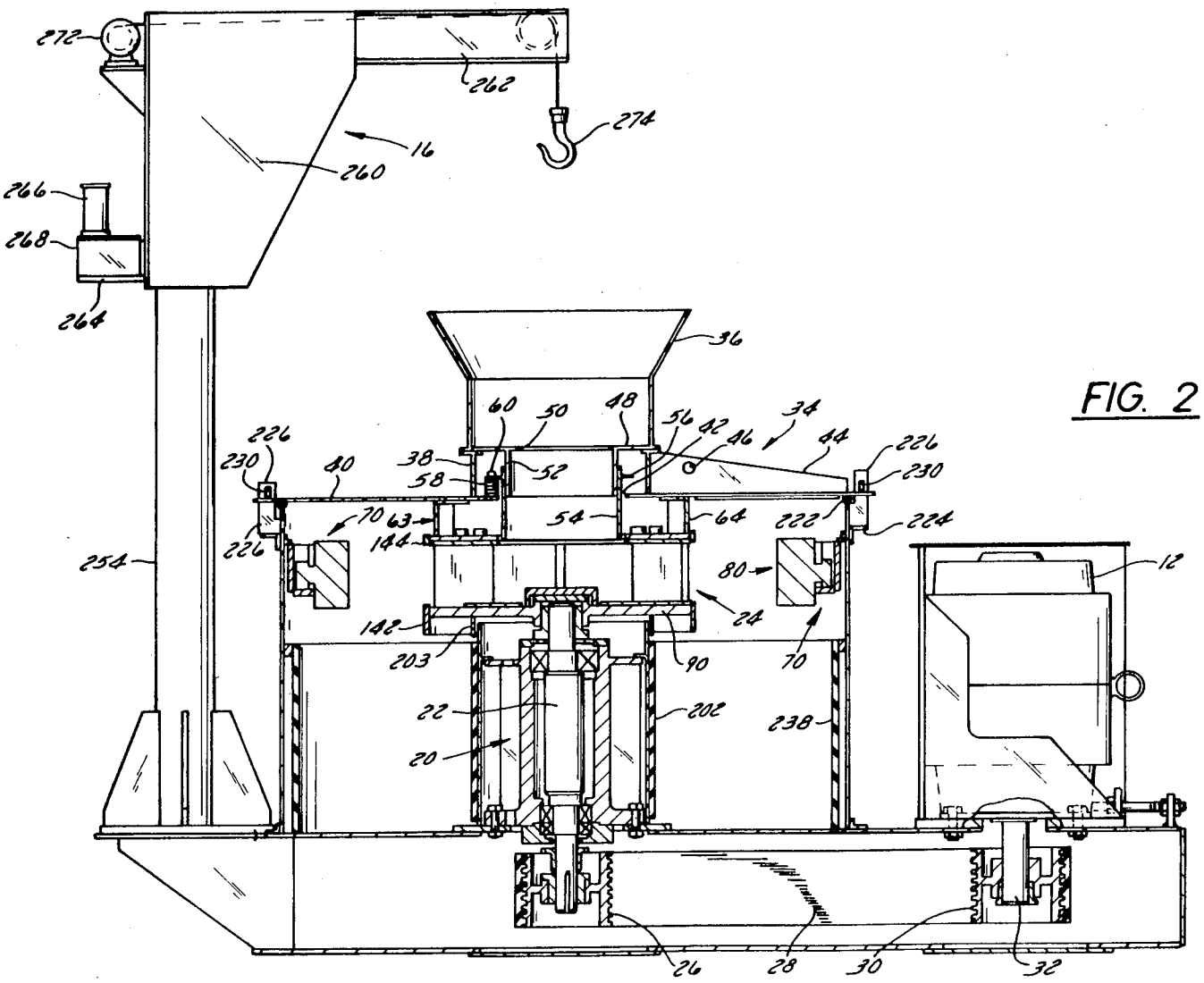
FIG. 2 is a sectional elevation of the vertical shaft impactor shown in FIG. 1 with the anvil breaker ring installed.
Figure 3:
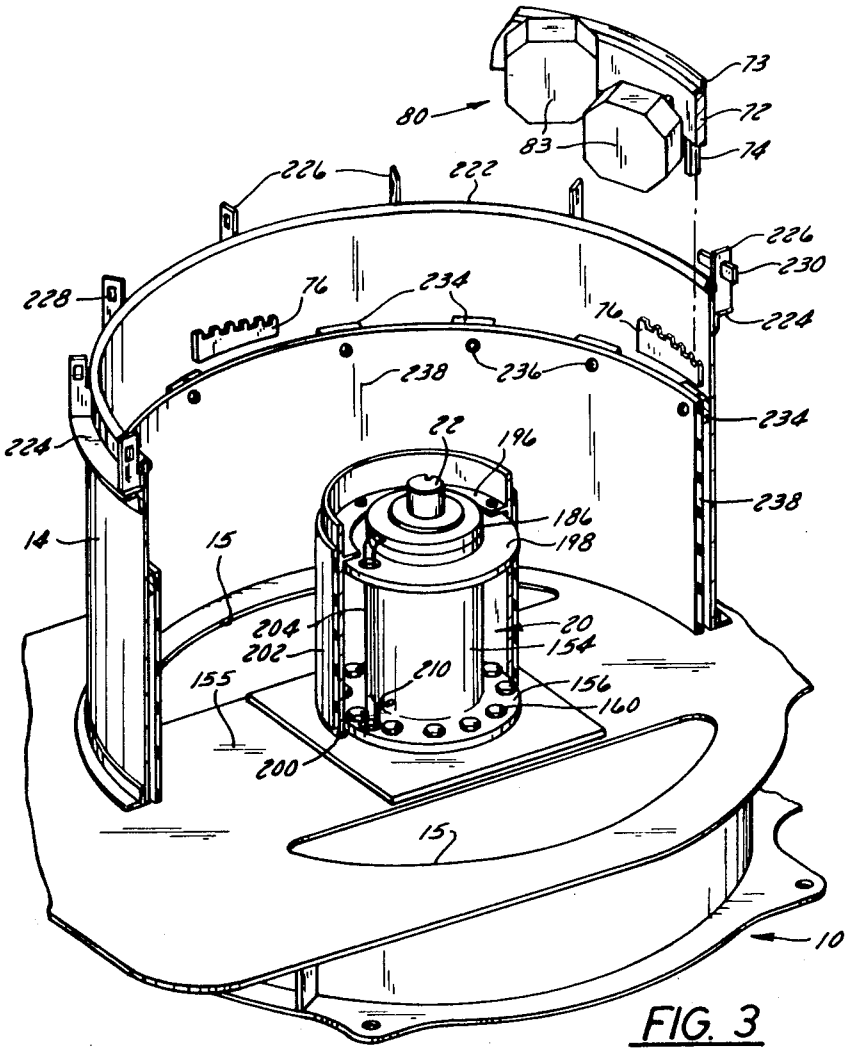
FIG. 3 is a partial sectional perspective of the vertical shaft impactor shown in FIG. 1 with the cover and rotor removed and a fragment of the breaker ring exploded out of the machine.

Turning now to the drawings wherein like characters designate identical or corresponding parts, and more particularly to FIGS. 1, 2 and 3 thereof, a vertical shaft impactor according to the present invention includes a frame 10 on which is mounted a drive motor 12, a crusher tank 14 bolted to the frame concentrically around a pair of segmental openings 15 therethrough, a crane 16, and a grease reservoir 18. A bearing cartridge 20 is also mounted directly to the frame 10 coaxially within the crusher tank 14. The bearing cartridge 20 supports for rotation about a vertical axis a shaft 22 which has mounted on its top end a rotor 24 and, mounted on its lower end, a sheave 26 which is connected by way of a drive belt 28 to a corresponding sheave 30 mounted on the lower end of the motor shaft 32.

A cover 34 is mounted on top of the crusher tank 14 and includes a feed funnel 36 mounted on a collar 38 which is welded to a cover plate 40 concentrically with a central hole 42 in the cover plate 40. A series of three radially extending tapered braces 44 are welded to the collar 38 and to the cover plate 40 to strengthen the cover and provide, by virtue of holes 46 in the braces 44, means for attaching a hoist cable from the crane 16 when it is desired to lift the cover off of the crusher tank 14.

The feed tube 36 has a floor plate 48 having a central opening 50. A feed tube 52 is welded to the underside of the floor plate 48 and depends downwardly therefrom to a level approximately equal to the cover plate 40. A replaceable feed tube extension 54 is telescopically disposed around the feed tube 52 and is provided with an extension adjustment mechanism for adjusting the length of its extension through the hole 42 in the cover plate 40. The adjustment extension mechanism includes an outwardly projecting flange 56 most clearly shown in FIG. 5, and a series of spacers 58 lined between the flange 56 and the region of the cover plate around the hole 42. The spacers 58 are held in position by a bolt 60 which extends through the flange, the spacers and the top plate 40. A series of access openings 62 in the collar 38 allows access to the bolt 60 for removing or adding spacers 58 to change the vertical position of the feed tube extension 54. The spacers 58 are u-shaped in plan view so that there is no need to remove the bolt 60 when adding or removing spacers.

A guard shell 63 made of a series of shell segments 64 is bolted to the underside of the cover plate 40 concentrically around the central hole 42. The shell segments are arcuate in form and include an inwardly extending upper flange by which the segments 64 are bolted to the cover plate. The liner segments 64 protect the top of the rotor 24 from damage by broken rock bouncing off of a breaker ring 70 mounted in the crusher tank 14 horizontally aligned with the rotor 24.

Figure 5:
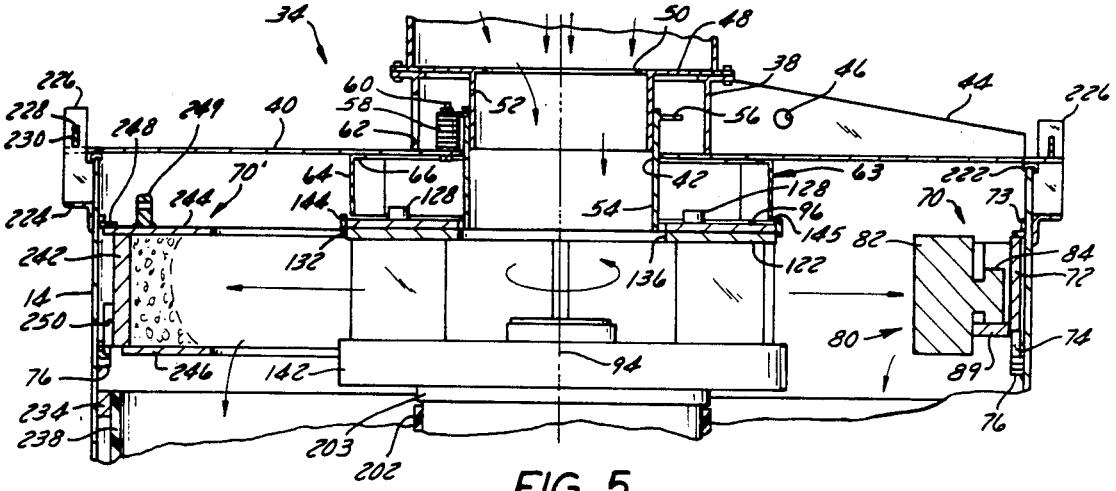
FIG. 5 is a sectional elevation of the upper end of a vertical shaft impactor shown in FIG. 1 showing, on the left side, the autogenous breaker ring and, on the right side, the anvil breaker ring.
Figure 6:
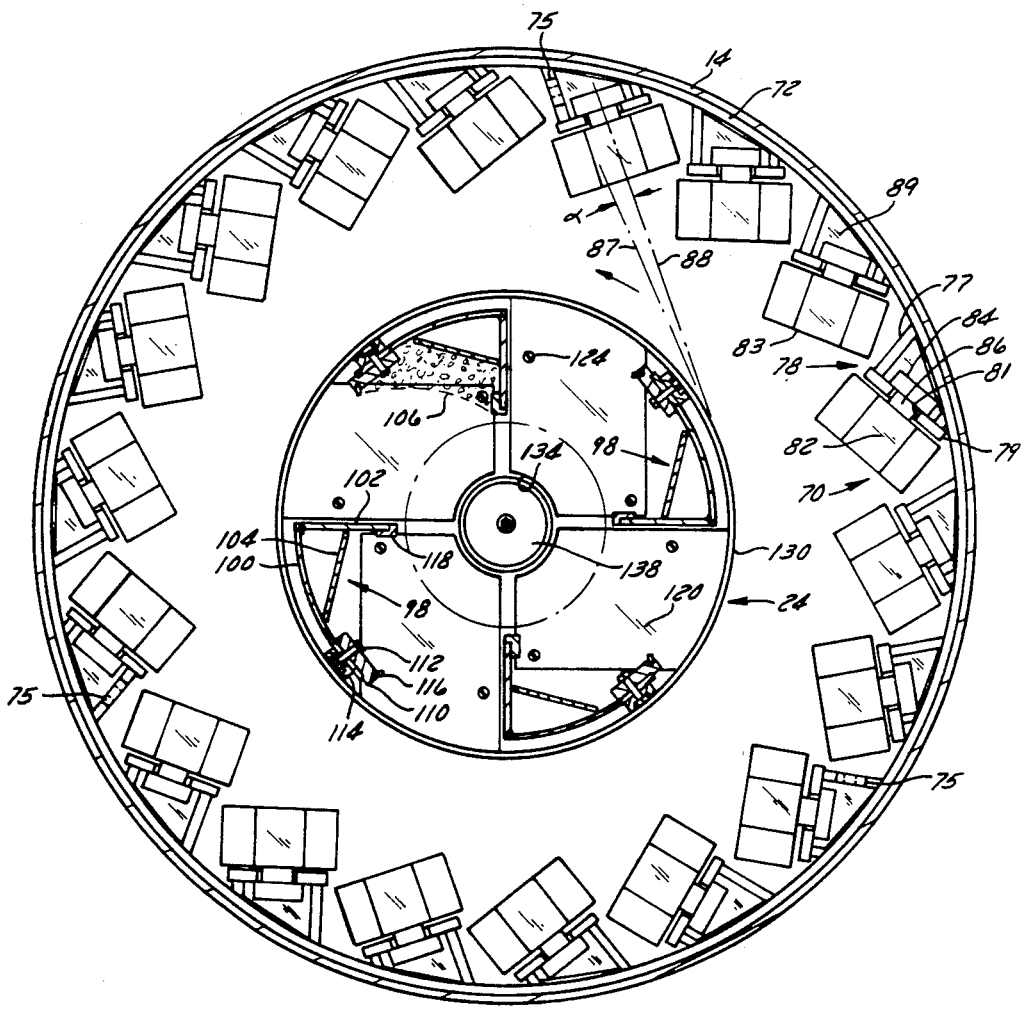
FIG. 6 is a plan view of the rotor and anvil breaker ring in the vertical shaft impactor shown in FIG. 2.
Figure 7:
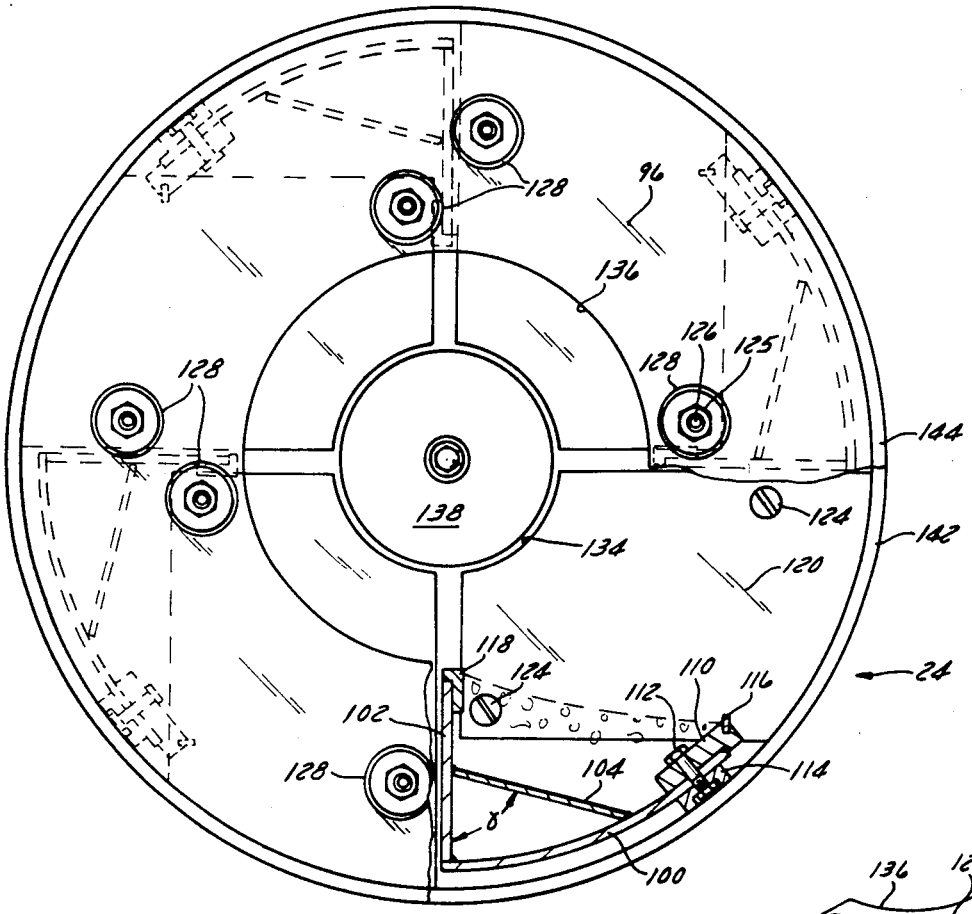
FIG. 7 is an enlarged plan view of the rotor shown in FIG. 6.

The breaker ring 70 shown in FIG. 2 and shown in greater detail in FIGS. 3, 5 and 6 includes an annular hoop 72 of heavy steel construction having an annular seal 73 fastened to its top surface for sealing the space between the hoop 72 and the crusher tank 14. Three depending vertical legs 74 are welded to the underside of the hoop 72 at equally spaced angular positions around the hoop. The legs 74 are supported by three stepped mounting blocks 76 welded to the inside of the crusher tank 14, as shown most clearly in FIG. 3. The support blocks 76 have a plurality of steps formed thereon at different angular positions and elevations to provide a plurality of elevation settings for the breaker ring. This enables the elevation of the breaker ring to be adjusted within the crusher tank 14 so that the vertical position of the breaker ring relative to the rotor can be optimized for optimal breaking efficiency and use of material, as explained more fully below.

The breaker ring 70 has welded thereon a series of brackets 78, each having two legs 77 fastened to and extending inwardly from the hoop 72 on a secant to the circle defined by the hoop. A cross arm 79 is welded to and extends between the outside ends of each pair of legs 77 and has a vertical slot 81 completely through the arm 79. The cross arm 79 is actually made of two separate pieces, one each welded to the end of each leg 77. Three lifting lugs 75 are welded to three legs 77 at equally spaced angular positions around the breaker ring for attachment of a cable to hoist the breaker ring in and out of the tank 14.

An anvil 80 is supported by each bracket 78. Each anvil 80 includes an octagonal head 82 having a flat octagonal face 83, a square foot 84, and a square neck connecting the head 82 and the foot 84. The head, foot and neck of the anvil 80 are symmetrical about a horizontal axis 88 forming an angle with the tangent 86 of the rotor through the anvil of about 5–15°, with 10° being preferred as shown in FIG. 6. This angle represents the radial component of velocity exerted by the rotor on the rock as it is propelled from the rotor. The radial component of velocity is a function of the rotor pocket face angle, as discussed below.

Each anvil 80 is supported on a bracket 78 by lowering the anvil neck 87 into the slot 81 in the cross arm 78 until the anvil foot 84 contacts a support plate 89 welded to the bottom the bracket legs 77 and cross arm 79. The support plates 89 support the vertical weight of the anvils 80 and also rigidify the brackets 78.

The brackets 78 are welded from simple flame-cut pieces for great economy and precision of manufacture, and also great strength. The anvils 80 each weigh about 200 lbs. and it is desirable that they be held securely to the breaker ring. The pieces all overlap each other slightly to provide convenient and economical outside rabbets in which the pieces can be quickly and securely welded. The structure is so open and accessible that it is particuarly suitable for automatic welding operations.

The octagonal faces 83 of the anvil heads 82 represent an efficient utilization of anvil material, since the corners of a square or rectangular anvil are not impacted by rock in a centrifugal impact crusher. The octagonal face is symmetrical about the axis 88 of the anvil so that the anvils may be rotated by multiples of 90° without changing the pattern of anvil faces presented to the rotor 24. It is thus possible to maintain a substantially uniform and consistent anvil array throughout the useful life of the anvil.

The support blocks 76, spaced at equal angular positions around the crusher tank 14, enable the breaker ring 70 to be rotated to as many positions as there are support blocks 76, three being disclosed herein. In practice, the rocks tend to be thrown predominantly in one angular region because they tend to fall into the rotor predominantly toward one side because of the conveyor feeder. Consequently, the anvils 80 in that one angular region tend to wear faster then in other regions. By periodically rotating the breaker ring incrementally, it is thus possible to distribute the anvil wear more evenly.

The rotor, as seen in FIGS. 2 and 6 through 9, includes a circular base plate 90 having an axial hub 92 formed integrally on the vertical centerline 94 of the rotor. A top plate 96 is disposed vertically above and parallel to the base plate 90 and coaxial therewith. The top plate 96 is held in space relationship to the base plate 90 by a series of vertically oriented partitions or plates which form four autogenous pockets 98 spaced equally around the rotor. Each pocket 98 is formed of a arcuate circumferential or peripheral plate 100 and a radial plate 102 welded to the trailing end of the circumferential plate 100 in the sense of the direction of rotation thereof. A pocket floor plate 104 is welded at an angle of about 76° between the radial plate 102 and the arcuate plate 100. The angle is selected to lie approximately parallel to the top face 106 of the dirt and rock bed which collects and is held in the pocket 98 while the machine is in operation, although the angle of face 106 may be adjustable by the technique disclosed below. The pocket floor plate 104 reduces the mass of the rock bed in the pocket to minimize the severity of the imbalance if one rock bed becomes dislodged.

The leading edge of each arcuate plate 100, on the end remote from the end to which the radial plate 102 is connected, has attached thereto a wear resistant bar 110. The wear resistant bar 110 is attached to the leading edge of the arcuate plate 100 by two bolts 112 which pass through a back-up bar 114 on the outside of the arcuate plate 100 to protect the bolts 112 from erosion by broken rock ricocheting off the anvils 80. The leading inside edge of the wear resistant bar 110 includes a slot in which is fixed, as by silver soldering, a piece of hard wear resistant material 116 such as silicon carbide.

The radial inside edge of the radial plate 102 is protected from erosion by a wear bar 118. The wear bar 118 is an L-shaped member which is held in place on the radial plate 102 by tack welding and is removed by burning through the tack welds with a torch. The wear bar 118 is made of a high chrome steel and does not require the silicon carbide insert as used in the wear bar 110 because the wear bar 118 is much closer to the axis of the rotor than the wear bar 110, so it is not subjected to the same degree of errosive action that the wear bar 110 experiences as rocks are accelerated off its leading edge.

The angle selected for the face 106 of the rock bed in the pocket 98 is controlled by length of the radial plate 102 and the effective length of the peripheral acruate plate 100. The effective length of both plates can be varied by the use of different wear bars 110 and 118 having greater length so they effectively extend either the radial plate 102 (for a smaller angle of the face of the rock bed) or the arcuate plate 100 (for a greater angle of the rock bed face).

To increase the shattering effect of the rotor itself on the rock, it may be desirable to replace the autogenous rotor pocket structure with conventional cast iron impeller shoes. The rotor 24 of this invention will accommodate the installation of conventional shoes mounted directly to the walls 100, 102 and 104, or could be mounted directly to the rotor base plate 90 in place of the autogenous pocket walls.

A pair of wear plates 120 and 122 is fixed to the rotor base plate 90 and the rotor top plate 96, respectively, in each of the four quadrants of the rotor. The bottom wear plate 120 is fixed to the top surface of the rotor base plate 90 by a pair of bolts 124 which pass through the wear plate 120 and the rotor base plate 90 and are locked into position by suitable locking nuts such as beam nuts 125 or the like. The upper wear plate 122 is fixed to the underside of the rotor top plate 96 by a pair of bolts 126 which pass through the wear plate 122 and the top plate 96 and are held into position by similar beam nuts 125. The portion of the upper wear plate nuts 125 and bolts 126 which project above the top surface of the rotor top plate 96 are protected from erosion by ferrules 128 which are welded to the top surface of the top plate 96 coaxial with the bolts 126.

Figure 9:
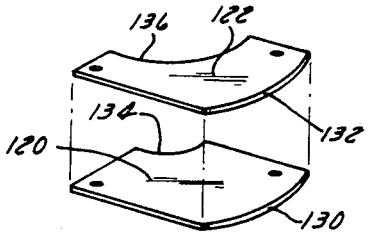
FIG. 9 is a perspective view of the two wear plates in one quadrant of the rotor shown in FIGS. 7 and 8.

As shown in FIG. 9, the bottom and upper wear plates 120 and 122 have an arcuate outer edge 130 and 132, respectively, which conforms to the outer circumferential configuration of the rotor base plate 90 and the rotor top plate 96, respectively, and arcuate radial inner edges 134 and 136, respectively, which are at different radii from each other. The plates 120 and 122 are otherwise identical. The radius of the inside edge 136 of the upper wear plate 122 is equal to or slightly smaller than the radius of the central opening in the rotor top plate 96, and the radius of the inside edge 136 of the bottom wear plate 120 is equal to the radius of a protective cap 138 which is bolted to a cover plate 140 which lies over the top of the hub 92. The other three edges of the wear plates 120 and 122 are straight and orthogonally oriented so that the wear plates may be slid straight into and out of the rotor when they are being replaced.

The plates 120 and 122 are simple designs that are easy to manufacture economically. They can be made from rectangular plates by flame cutting an outside radius on one side which will be the same for both top and bottom plates, and a circular arc on one corner concentric with the outside radius. The cutting can be done at high volume and low expense by automated ganged plasma arc. The plates are very easy to handle because they are flat and can be stacked flat or on edge.

A protective skirt or lower outer guard ring 142 is tack welded around the outside periphery of the rotor base plate 90, projecting vertically slightly above the top surface thereof and vertically below the top surface thereof a distance approximately equal to the thickness of the rotor base plate 90. The skirt 142 protects the edge of the rotor base plate 90 from erosion and also provides a shoulder by which the position of the bottom wear plate 120 can be located for ease of insertion of the bolts 124 when the wear plate 120 is replaced. The bottom extension of the skirt 122 protects the lower projection of the bolts 124 and the nuts 125 from erosion by rock fragments ricocheting off of the anvils 80.

The skirt 142 is attached to the rotor base plate 90 by placing a split, which becomes the skirt 142 after attachment, around the base plate 90 and supporting it in position for welding or other fusion joining, such as brazing. The annular hoop has a diameter slightly smaller than the diameter of the base plate 90 so there is a gap between adjacent edges of the hoop at the split when it is placed on the base plate 90. The hoop is then tack welded to the base plate 90 at the shoulder formed at the junction of the lower outside edge of the rotor base plate 90 and the hoop adjacent to one edge of the hoop at the split. The hoop is progressively tack welded to the base plate 90 around the full circumference of the hoop. The welding heats the hoop so that it thermally expands and the gap at the parting line closes as the hoop gets hot. At the conclusion of the tack welding, the hoop is welded closed at the parting line to produce a full circumferential skirt 142 which is welded and shrunk fit to the rotor base plate 90 for secure attachment.

A top guard ring or rim 144 is welded to the rotor top plate 96 in the same manner used to weld the protective skirt 142 to the rotor base plate 90. The top of the top rim 144 projects above the top surface of the top plate 96 and forms a shoulder 145 therewith. The guard shell 63 extends down from the cover 34 just inside of and closely adjacent to the top rim 144. The closely spaced top rim 144 and guard shell 63 cooperate together in the manner of a labyrinth seal to restrict the entrance of rock chips and dust from the region above the rotor where they could cause errosive damage to the rotor top plate and adjacent structures.

The skirt 142 and the top rim 144 provide a prestressed support ring to radially support the wear plates 120 and 122. Under high centrifugal force, the skirt and rim, if not prestressed, could expand slightly and lessen the radial support provided to the wear plates. Although the bolts 124 and 126 are sized to hold the wear plates in place, the prestressed skirt and rim provide additional security to relieve the load on these bolts.

When the skirt 142 and rim 144 become worn, they are easily replaced during servicing of the rotor by burning out the tack welds which hold the skirt and rim to the rotor base plate 90 and top plate 96, and then welding on a new pair. When the wear plates 120 and 122 become worn, they are easily removed by removing the bolts 124 and 126 and sliding the wear plates out over the protective lip provided by the skirt 142 and top guard ring or rim 144. The parallel edges of the wear plates facilitate easy removal and replacement. It is an advantage to be able to replace the guard rings and wear plates separately only when they become worn. Even though the replacement procedure is very fast, the cost of the replacement parts is better saved if there is useful life remaining in the part.

Figure 8:
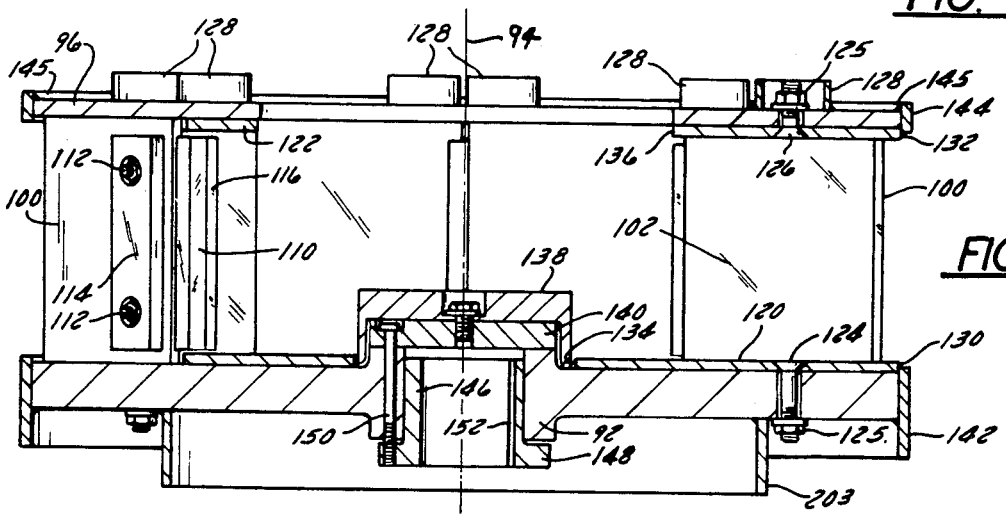
FIG. 8 is an enlarged sectional elevation of the rotor shown in FIG. 7.

As is shown most clearly in FIG. 8, the rotor hub 92 is held to the top of the shaft 22 by a tapered collar 146 having a lower radial flange 148. A series of tapped holes in the flange 148 threadedly receive the threaded ends of bolts 150 which extend through aligned holes in the cover plate 140 and the hub 92. The collar 146 may be slotted at 152 to receive a key on the end of the shaft 22. The bolts 150 are tightened to force the tapered collar 146 into the tapered bore of the hub 92 which squeezes the collar down against the shaft to firmly lock the rotor 24 onto the end of the shaft 22.

Figure 4:
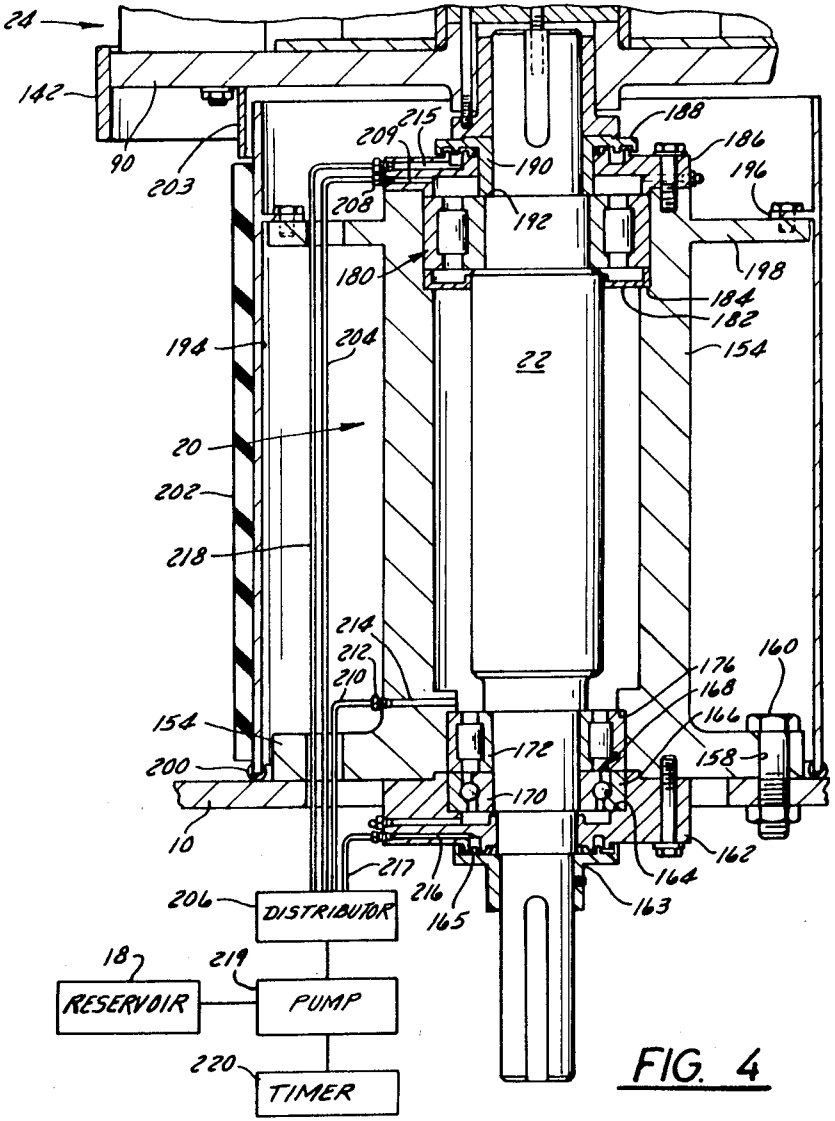
FIG. 4 is a sectional elevation of the bearing cartridge for the vertical shaft impactor shown in FIG. 1 and a portion of the rotor mounted on the top end thereof.

The shaft 22 is supported by a cylindrical bearing cartridge 20 shown best in FIGS. 3 and 4. A heavy cylindrical cartridge housing 154 is attached to a bridge 155 in the base between the two segmental openings 15 by bolting a lower flange 156, integral with the housing 154, and in which is drilled a plurality of holes 158 which receive bolts 160 by which the bearing cartridge housing 154 is fastened to frame bridge 155.

A lower cartridge closure 162 is bolted to the lower axial end of the housing 154 coaxially with the housing axis. A special ring 163 is held on the lower end of the shaft 22 with a suitable set screw or the like, and includes a flange 165 having a labyrinth seal configuration on its upper surface which mates with a complementary labyrinth seal configuration on the lower surface of the lower cartridge closure 162. The cartridge closure 162 has a shoulder 164 which receives the outside race 166 of a thrust bearing 168. The weight of the shaft and the rotor which it supports is borne on the inside race 170 of the thrust bearing 168. The shaft load is exerted on the inside race 170 through the inside race 172 of a radial bearing 174 positioned immediately above the thrust bearing 168. The shaft load is carried by the inside race 172 by virtue of its engagement with a shoulder 176 on the shaft 22.

A radial bearing 180 provides radial support of the shaft 22 at the top end of the bearing cartridge housing 154. A bearing cup 182 is supported on an inside shoulder 184 on the inside of the bearing cartridge housing 154. The bearing cup 182 restricts drainage of lubricant from the top radial bearing 180. A top cartridge closure 186 is bolted to the top of the bearing cartridge housing 154 and includes on its top inner periphery a labyrinth seal configuration which mates with a corresponding labyrinth seal configuration on the lower face of a flange 188 on an annular seal ring 190 which seats on a shoulder 192 on the shaft 22. When the rotor is placed onto the top end of the shaft 22, the weight of the rotor is borne on the seal ring 190 and the weight is transmitted to the shaft 22 through the engagement of the lower end of the seal ring with the shoulder 192 on the shaft 22.

A cylindrical dust shell 194 surrounds the bearing cartridge 20 and is supported thereon by a radially inwardly extending flange 196 which is bolted to a radially outwardly extending flange 198 adjacent the top of the cartridge housing 154. A rubber bumper 200 is fitted on the lower end of the dust shell 194 and is slightly compressed between the dust shell and the frame 10 to exclude dust from the bearing cartridge and to dampen vibration and minimize noise. A urethane shield 202 is secured to the outside surface of the dust shell 194 to prevent abrasive damage to the dust shell and also to dampen vibration and minimize noise. The urethane shield 202 may be bolted to the dust shell or may be bonded directly to the shell.

A lower inner dust guard ring 203 is welded to the underside of the rotor base plate 90 concentric with the rotor axis, adjacent to and outside of the dust shell 194, and immediately above the urethane shield 202. The close spacing of the guard ring 203 to the dust shell 194 and the shield 202, and the rotation of the guard ring relative to the stationary shell and shield tends to exclude dust so that the interior of the dust shell 194 stays clean. All of the outside guard rings, namely, the skirt 142, the top rim 144 and the dust guard ring 203 are attached to the rotor 24 and rotate with it. Since most rock fragments that strike the guard rings on the rebound from the anvils 80 will have a component of velocity in the direction of rotor motion, the errosive action of the rock on the guard rings will be lessened.

The bearing cartridge is sealed and lubricated by an automated grease injection system that injects grease from the reservoir 18 into the labyrinth seals for sealing and into the bearings for lubrication. The grease injection system includes a grease line 204 which runs from a grease distributor 206 to a fitting 208 through which the grease is conveyed into and through a radial passage 209 in the top cartridge closure 186 to the annular space immediately above the top radial bearing 180. The lower radial bearing 174 and the thrust bearing 168 are lubricated through a grease line 210 which runs from the grease distributor 206 to a fitting 212 on the cartridge housing 154 through which grease is conveyed to and through a radial passage 214 in the housing 154 to the space immediately above the radial bearing 172. Grease works through the lower radial bearing 174 and into the thrust bearing 168.

The upper and lower grease seal utilize the labyrinth seal configuration between the upper and lower seal rings 190 and 163, and the upper and lower cartridge closures 186 and 162. Grease passages 215 and 216 in the cartridge closures 186 and 162, respectively are connected by grease lines 217 and 218 to the distributor 206 for injection of grease into the labyrinth seal cavities to prevent the entrance of stone dust or other abrasive foreign matter into the bearing housing, which could damage the bearings. The grease is injected into the bearings and the seal cavities by a pump 219 controlled by a timer 220. The timer causes the pump to operate periodically and the distributor 206 causes the grease to be distributed evenly through each of the four lines so that grease is distributed to the seals and the bearings for certain lubrication and sealing action. If there is a failure in the distributor or the pump, an internal alarm operates to alert the operator of the problem so that corrective action may be taken immediately.

The use of a common grease injection system for both sealing and lubrication greatly simplifies and improves the bearing system. Conventional lubrication uses an oil circulation system for flushing dirt and heat out of the bearing, but such a system is more expensive than the grease system disclosed herein because it requires an oil return and filter network, continuous pump operation, and is more susceptible to catastrophic bearing failure in the event of pump malfunction. By properly sizing and sealing the bearings in this application, a simple, reliable and inexpensive grease lubrication system has been provided that positively seals and lubricates using the same fluid.

Referring now to FIGS. 2 and 3, the crusher tank 14 is a cylindrical tank having a rubber bumper 222 placed on the top lip of the tank to act as a dust seal and also to dampen vibration and attenuate noise. An annular bracket 224 is welded around the outside surface of the tank slightly below the top lip and provides a support to which the bottom edge of a plurality of upright locking tongues 226 are welded. Each of locking tongues has a rectangular hole 228 punched in its upper end for receiving a lock wedge 230. The cover plate 40 has a series of short radial slots 232 at its outside edge at angular positions corresponding to the angular positions of the locking tongues 226 around the tank 14, so that when the cover is placed on the top of the tank 14 with the locking tongues lined up with the slots 232, the tongues 226 will extend through the slots 232 and the lock wedges 230 may be driven into the holes 228 to lock the cover in place.

A series of spacer blocks 234 is welded on a horizontal line around the inside of the tank just beneath the stepped support blocks 76. The spacer blocks 234 are each drilled and tapped to accept a bolt 236 which fastens a rubber curtain 238 at its top edge to the spacer blocks. The rubber curtain 238 hangs down to the floor around the full inside circumference of the crusher tank 14. It prevents abrasion to the tank wall and is extremely effective in damping vibration and noise during operation.

The anvil breaker ring 70 can be removed by attaching a cable hook to each of three lifting lugs 75 attached to three bracket legs 77 at equally spaced positions around the annular hoop 72 of the breaker ring 70, and lifting the breaker ring out of the crusher tank 14. The breaker ring 70 may be replaced with a similar breaker ring 70 or may be replaced with an autogenous breaker ring 70' shown in cross section on the left-hand side of FIG. 5. The autogenous breaker ring 70' is an inwardly opening channel which is arranged horizontally opposite the rotor 24 for receiving and holding rock thrown by the rotor so that additional rock will impact the rock in the autogenous breaker ring 70' and the rock breaking action will be rock on rock rather than rock on metal.

The autogenous breaker ring 70' includes an annular cylinder 242 to the top and bottom of which are welded an annular top disk 244 and annular bottom disk 246, respectively. The top disk 244 is of a slightly larger radius than the bottom disk and extends almost to the inside surface of the crusher tank 14. A full annular seal 248 is fastened to the top of the top disk 244 for the same purpose as the seal 73, namely, to prevent rock and dust from settling down behind the breaker ring 70' and falling between the rubber curtain 238 and the crusher tank 14. The seals 73 and 248 also prevent rock from becoming wedged between the breaker ring and crusher tank 14 when the breaker ring is lifted out of the tank so that rocks do not become jammed between the ring and the tank 14. Three equally spaced lifting lugs 249 are welded to the top surface of the top disk 244 for use in hoisting the breaker ring 70' into and out of the tank 14.

Three legs 250 are welded to the outside surface of the annular cylinder 242 for supporting the autogenous breaker ring 70' on the stepped support blocks 76. The verticle extension of the annular cylinder 242 on the autogenous breaker ring 70' is greater than the vertical extent of the annular hoop 72 of the anvil breaker ring 70 so that space between the cylinder 242 and the inside wall of the crusher tank 14 accommodates the upper steps of the stepped support blocks 76 when the autogenous breaker ring is set on the lower steps.

The crane 16 includes a support pillar 254 to which a pair of brackets 256 are attached for supporting a crane control box 258 by which the crane 16 is controlled. A bearing (not shown) around the upper portion of the support pillar 254 rotatably supports the upper end of the crane 16 which includes a vertical extension 260 and a cantilevered horizontal arm 262. A support bracket 264 is welded to the lower end of the vertical extension 260 and supports an electric motor 266 coupled to a gear pump 268.

A hydraulic rotation motor (not shown) is coupled between the upper portion of the crane 16 and the support pillar to allow the upper portion of the crane to be rotated about the support pillar. A hydraulic winch motor 270 is coupled to a hydraulic winch 272 which allows a hook 274 to be raised or lowered by taking up or playing out cable from a winch drum 276.

The power functions of the crane 16 are controlled from the control box 258 which contains pilot valves or electric switches for controlling the control valves 278 by which motive fluid from the pump 268 is delivered to the winch motor 270 and the rotation control motor (not shown).

In operation, rock to be crushed is continuously fed into the feed funnel 36 and falls through the feed tube 52 and the feed tube extension 54 and into the center of the rotor 24. The rotor rotates at a speed on the order of about 1,000 RPM which throws the rock radially outward where it is caught and accelerated by the rotor pockets 98. The rotor pockets are covered with a blanket of rock which is held within the pocket to protect the pocket members from erosion by the rock as it is thrown outward. The only surfaces which encounter erosion within the pocket are the top and bottom wear plates 122 and 120 and the inner and outer wear bars 118 and 110. These wear pieces are all easily and quickly replaceable when they wear down.

The rock is thrown by the pockets 98 outward against either the anvil breaker ring 70 or the autogenous breaker ring 70'. The trajectory of the rock is shown in FIG. 6 and is about 5°–15° out from the tangent to the rotor. The deviation from tangential trajectory is caused by the angle of the rock face within the pocket 98 and coefficient of friction of the rock on rock as the rocks are thrown radially outwardly. The brackets 78 are set in the breaker ring 70' at an angle such that the faces of the anvils 80 lie perpendicular to the flight trajectory of the rock which is about 10° out of the tangent to the rotor. In this way, the rocks will strike the anvil faces exactly perpendicular so that the full momentum of the rock is converted to an internal shattering force and little of the energy is wasted on ricochet force.

The broken rock then falls vertically downward between the rubber curtain 238 and the dust shell 194 and falls through the openings 15 on the two sides of the cartridge support ridge 155. The rock is then carried away by suitable conveyor belt (not shown).

Obviously, numerous modifications and variations of the above-described preferred embodiment will occur to those skilled in the art in light of this disclosure. Accordingly, it is expressly to be understood that these modifications and variations, and the equivalents thereof, may be practiced while remaining within the spirit and scope of this invention as defined in the following claims.

We claim:

1. A vertical shaft impact crusher, having a cylindrical tank in which a rotor is mounted for rotation about a vertical axis for receiving rock fed axially from above and having shoes for accelerating and throwing the rock outward against an annular breaker ring, wherein said breaker ring comprises:

a circular hoop of a radius slightly smaller than the radius of said tank;

a series of brackets welded to the inside of said hoop at angularly spaced positions therearound, said brackets each having two legs fastened to and extending inwardly from said hoop on a secant to the circle of said hoop; a cross arm fastened to said legs and extending between them; means in said cross arm defining a vertically elongated slot extending completely therethrough; and a support plate fastened to the bottom of said legs and said cross arm;

an anvil supported by each of said brackets, each anvil having a central axis and a massive head with a flat face lying perpendicular to said central anvil axis, said head having a regular octagonal cross-sectional shape symmetrical about said central anvil axis;

said anvil further comprising a neck having a cross-sectional polygonal shape perpendicular to and symmetrical about said anvil axis and which is slightly narrower, along a line perpendicular to the faces of said polygon and through said anvil axis, than the width of said slot in said cross arm;

a foot connected to said head by said neck and having a cross-sectional polygonal shape similar to said cross-sectional polygonal shape of said neck and substantially wider, along a line perpendicular to the faces of said foot polygonal shape and through said anvil axis, than the width of said slot in said cross arm; and said foot and neck polygonal shape and having a number of faces equal to a multiple of four so that said anvil may be oriented at a number of angular positions equal to said multiple of four and, in each of said positions said foot will rest on one of the polygonal faces thereof and be supported by said support plate in sable manner, and said cross arm will engage the inside face of said foot and either side of said neck to prevent said anvil head from tipping downwardly, so that as a portion of said anvil becomes worn, said foot and neck may be rotated in said bracket to present a relatively uneroded anvil surface to said outwardly thrown rock.

2. The vertical shaft impact crusher defined in claim 1, wherein said cross arms each include two separate pieces welded to the ends of said legs, respectively, and to said support plate.

* * * * *

UNITED STATES PATENT AND TRADEMARK OFFICE

CERTIFICATE OF CORRECTION

PATENT NO. : 4,575,014

DATED : March 11, 1986

INVENTOR(S) : Scott E. Szalanski and Kenneth Tess

It is certified that error appears in the above-identified patent and that said Letters Patent are hereby corrected as shown below:

Column 12, line 24, between "shape" and "having", delete "and".

Column 12, line 30, "sable", should read --stable--.

Signed and Sealed this

*Seventeenth* Day of *June 1986*

[SEAL]

*Attest:*

DONALD J. QUIGG

*Attesting Officer*

*Commissioner of Patents and Trademarks*